US009190236B2

(12) United States Patent
Kibushi et al.

(10) Patent No.: US 9,190,236 B2
(45) Date of Patent: Nov. 17, 2015

(54) FUSE UNIT

(75) Inventors: Hidenori Kibushi, Makinohara (JP); Tatsuya Aoki, Makinohara (JP)

(73) Assignee: Yazaki Corporation, Tokyo (JP)

( * ) Notice: Subject to any disclaimer, the term of this patent is extended or adjusted under 35 U.S.C. 154(b) by 78 days.

(21) Appl. No.: 13/497,387

(22) PCT Filed: Oct. 1, 2010

(86) PCT No.: PCT/JP2010/067700
§ 371 (c)(1),
(2), (4) Date: Mar. 21, 2012

(87) PCT Pub. No.: WO2011/040650
PCT Pub. Date: Apr. 7, 2011

(65) Prior Publication Data

US 2012/0176216 A1 Jul. 12, 2012

(30) Foreign Application Priority Data

Oct. 2, 2009 (JP) ..... 2009-230528

(51) Int. Cl.
*H01H 37/04* (2006.01)
*H01H 85/044* (2006.01)
(Continued)

(52) U.S. Cl.
CPC ..... *H01H 85/044* (2013.01); *H01H 85/20* (2013.01); *H01H 85/2045* (2013.01); *H01H 2085/025* (2013.01); *H01H 2085/0555* (2013.01); *H01R 13/6273* (2013.01)

(58) Field of Classification Search
CPC ..... H01H 85/044; H01H 85/2045; H01H 2085/025; H01H 2085/0555; H01H 85/20; H01H 2223/05; H01R 13/6273
USPC ..... 337/186
See application file for complete search history.

(56) References Cited

U.S. PATENT DOCUMENTS 4,037,905 A * 7/1977 Lucas ..... H01R 4/2454 439/395
6,186,814 B1 * 2/2001 Matsushita ..... H01R 13/6271 439/271

(Continued)

FOREIGN PATENT DOCUMENTS

EP 1124246 A2 8/2001
EP 1255271 A2 11/2002
JP 2002-329457 A 11/2002

OTHER PUBLICATIONS

International Search Report dated Feb. 1, 2011 in counterpart international application No. PCT/JP2010/067700.

(Continued)

*Primary Examiner* — Anatoly Vortman
*Assistant Examiner* — Jacob Crum
(74) *Attorney, Agent, or Firm* — Sughrue Mion, PLLC

(57) ABSTRACT

A fuse unit including a fuse element therein includes a first resin body and a second resin body. The second resin body is connected to the first resin body by a hinge portion and configured to be bended around the hinge portion with respect to the first resin body. A pair of first side walls and a pair of second side walls are provided on the first resin body and the second resin body respectively and extend in a direction intersecting an axis of the bending of the second resin body. A pair of engaging parts are provided at the lock arms provided at the first side walls respectively respectively, and each of which has a first inclined face. A pair of engaged parts are provided at the second side walls respectively, and corresponds to the engaging parts respectively, and each of which has a second inclined face configured to contact the first inclined face in surface contact in a state that the second resin body is bended. The first inclined face and the second inclined face are formed along a direction intersecting a direction of a reaction force by springback of the fuse element caused by the bending of the second resin body.

9 Claims, 12 Drawing Sheets

(51) Int. Cl.

| | |
|---|---|
| *H01R 13/627* | (2006.01) |
| *H01H 85/20* | (2006.01) |
| *H01H 85/02* | (2006.01) |
| *H01H 85/055* | (2006.01) |

(56) References Cited

U.S. PATENT DOCUMENTS

| | | | | |
|---|---|---|---|---|
| 6,294,978 | B1 * | 9/2001 | Endo et al. | 337/166 |
| 6,341,972 | B1 * | 1/2002 | Odorfer | H01R 13/582 439/352 |
| 7,176,780 | B2 * | 2/2007 | Iwata | 337/188 |
| 7,663,465 | B2 * | 2/2010 | Matsumoto et al. | 337/187 |
| 7,663,466 | B1 * | 2/2010 | Jetton | 337/191 |
| 8,638,188 | B2 * | 1/2014 | Iwata et al. | 337/186 |
| 2001/0011939 | A1 * | 8/2001 | Inaba et al. | 337/265 |
| 2002/0163416 | A1 | 11/2002 | Matsumura | |
| 2007/0066118 | A1 * | 3/2007 | Oma | H01R 13/6273 439/357 |
| 2009/0108981 | A1 * | 4/2009 | Iwata et al. | 337/186 |
| 2009/0111316 | A1 * | 4/2009 | Matsumoto et al. | 439/374 |
| 2010/0066350 | A1 * | 3/2010 | Matsumura et al. | 324/120 |

OTHER PUBLICATIONS

Written Opinion dated Feb. 1, 2011 in counterpart international application No. PCT/JP2010/067700.

Office Action dated Apr. 28, 2014, issued by the State Intellectual Property Office of the People's Republic of China in corresponding Chinese Application No. 201080044540.X.

Office Action dated Dec. 3, 2014 issued by the State Intellectual Property Office of the People's Republic of China in counterpart Chinese Application No. 201080044540.

* cited by examiner

FUSE UNIT

TECHNICAL FIELD

The present invention relates to a fuse unit which is directly attached to a battery installed in an automobile and supplies electric power of the battery to an electric wire for supplying electric power.

BACKGROUND ART

FIG. 12 shows a conventional fuse unit 100 described in PTL 1. The fuse unit 100 is formed by building a fuse element (not shown) made of a conductive metal plate into a resin body 110. The resin body 110 is divided into forward and backward division bodies 120, 130 in a state of extending in a plane shape and in the case of being attached to a battery, the division bodies 120, 130 are bent in an L shape as shown in FIG. 12. The division bodies 120, 130 are bent about a hinge part of the fuse element exposed from the portion between the division bodies 120, 130. The fuse unit 100 is used in a state where the fuse unit 100 is bent to L shape, thus it can cope with circuit arrangement inside narrow space.

In the use state of the fuse unit as described above, it is necessary to hold a L-shaped bent state, so that the conventional fuse unit 100 is constructed as described below.

A regulation wall 140 facing an inner surface wall 121 of one division body 120 is erected in an inner surface wall 131 of the other division body 130, and an inclined wall surface 141 inclined in a direction separate from the inner surface wall 121 of one division body 120 is formed in the regulation wall 140. Also, bending rigidity of the regulation wall 140 is increased by disposing fall-prevention ribs 143 in both ends of the regulation wall 140.

Further, a lock arm 150 having a hook part 151 is disposed in one division body 120 and also a notch part 153 with which the hook part 151 engages is disposed in the regulation wall 140 of the other division body 130 and first lock means is formed. Also, a locking projection (not shown) is disposed in one division body 120 and an engaging groove 160 in which the locking projection locks is disposed in the other division body 130 and second lock means is formed. The engaging groove 160 is disposed in an extension wall 165 from side surface walls 133, 135 in the other division body 130.

When the other division body 130 is bent with respect to one division body 120 in such a structure, the regulation wall 140 of the other division body 130 abuts on the inner surface wall 121 of one division body 120. Also, by hooking the hook part 151 of the lock arm 150 in one division body 120 to the notch part 153, the lock arm 150 engages with the notch part 153 and is locked and also the locking projection of one division body 120 engages with the engaging groove 160 of the other division body 130 and is locked. Consequently, the state of bending the two division bodies in the L shape can be held.

CITATION LIST

Patent Literature

[PTL 1] JP-A-2002-329457

SUMMARY OF INVENTION

Technical Problem

In the conventional fuse unit 100, in a lock state in which the engaging groove 160 engages with the locking projection which is the second lock means, a gap may occur between the notch part 153 and the hook part 151 of the lock arm 150 which is the first lock means and due to occurrence of this gap, a lock force reduces and the lock state cannot be held in the first lock means.

Consequently, all the loads of springback from the built-in fuse element bent in the L shape act on the second lock means including the engaging groove 160 and an engaging projection disposed inside the extension wall 165, so that a holding force for holding the L-shaped bent state cannot be ensured sufficiently and there is a problem that the fuse unit 100 may be damaged.

Therefore, an object of the invention is to provide a fuse unit capable of being surely subjected to a load of springback from a built-in fuse element and holding a bent state of division bodies and preventing damage.

Solution to Problem

In order to achieve the object, according to the present invention, there is provided a fuse unit including a fuse element therein, the fuse unit having: a first resin body; a second resin body connected to the first resin body by a hinge portion and configured to be bended around the hinge portion with respect to the first resin body; a first opposing wall provided on the first resin body; a second opposing wall provided on the second resin body and opposing the first opposing wall, so that the hinge portion is disposed between the first opposing wall and the second opposing wall; a pair of first side walls provided on the first resin body and extending in a direction intersecting an axis of the bending of the second resin body; a pair of second side walls provided on the second resin body and extending in a direction intersecting the axis of the bending of the second resin body; a pair of lock arms provided at the first side walls respectively; a pair of engaging parts, provided at the lock arms respectively, and each of which having a first inclined face; and a pair of engaged parts, provided at the second side walls respectively, and corresponding to the engaging parts respectively, and each of which having a second inclined face configured to contact the first inclined face in surface contact in a state that the second resin body is bended, wherein the first inclined face and the second inclined face are formed along a direction intersecting a direction of a reaction force by springback of the fuse element caused by the bending of the second resin body.

The fuse unit may be configured such that: each of the engaging parts is a lock projection; each of the engaged parts is a protrusion; and the lock projection and the protrusion are configured to contact to each other and to slide according to the bending of the second resin body.

The fuse unit may be configured such that: the lock arms have flexibility; and the lock arms are configured to be deformed outward of the first side walls according to the bending of the second resin body.

The fuse unit may be configured such that: a straight line parallel to the first inclined face and extended from the first inclined face in a state the first inclined face and the second inclined face contact in surface contact intersects the axis of the bending of the second resin body.

Advantageous Effects of Invention

According to the present invention, the lock arms are disposed in the side wall parts of both sides of one division body and also the protrusions are disposed in the side wall parts of both sides of the other division body and when the two division bodies are bent, a state in which the first inclined surfaces formed in the lock arms are aligned with the second inclined surfaces disposed in the protrusions is obtained. In such a structure, the two division bodies are engaged in the side wall parts of both sides, so that a sure lock state is obtained.

Moreover, the first inclined surfaces and the second inclined surfaces are formed along the direction intersecting with respect to the reaction force by springback of the fuse element based on bending of the division bodies, so that in a state of alignment between the first inclined surfaces and the second inclined surfaces, these surfaces can surely be subjected to the reaction force by springback.

In the present invention, it can surely be subjected to a load of springback from the fuse element, so that a bent state of the division bodies can be held and damage can be prevented.

In addition, according to the present invention, the slide surface parts for sliding in mutual contact are formed in the lock projection and the protrusion, so that the lock projection and the protrusion slide relatively in the case of bending the division bodies. As a result of this, the first inclined surfaces of the lock projections are smoothly aligned with the second inclined surfaces of the protrusions and a lock of the bent state can be performed smoothly.

In addition, according to the present invention, the interference parts formed in the lock projections and the protrusions flex the lock arms in the case of bending the division bodies, so that the lock arms do not become an obstacle to bending of the division bodies and the first inclined surfaces can smoothly be aligned with the second inclined surfaces.

In addition, according to the present invention, the extension line of alignment between the first inclined surfaces and the second inclined surfaces matches with the center of bending of the division bodies, so that it can surely be subjected to the reaction force of springback of the fuse element based on bending of the division bodies and the bent state of the division bodies can be held more stably.

DESCRIPTION OF EMBODIMENTS

The invention will hereinafter be described concretely by an illustrated embodiment.

Figure 1:
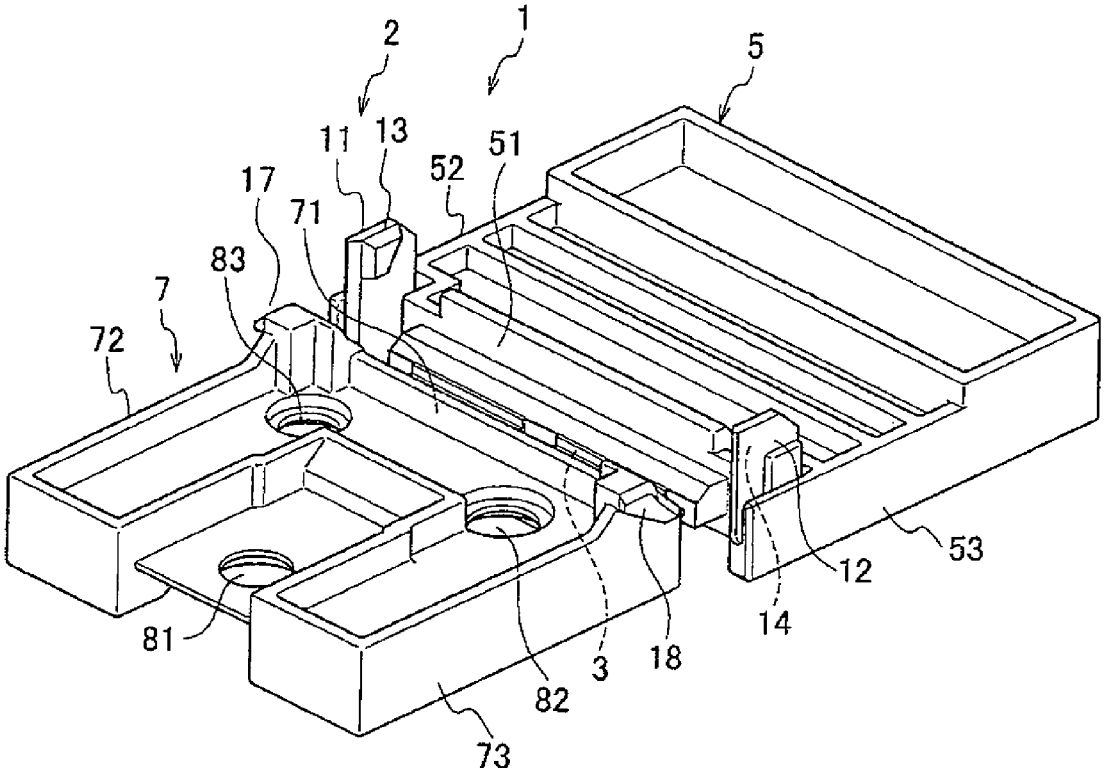
FIG. 1 is a perspective view before bending of a fuse unit 1 of one embodiment of the invention.
Figure 2:
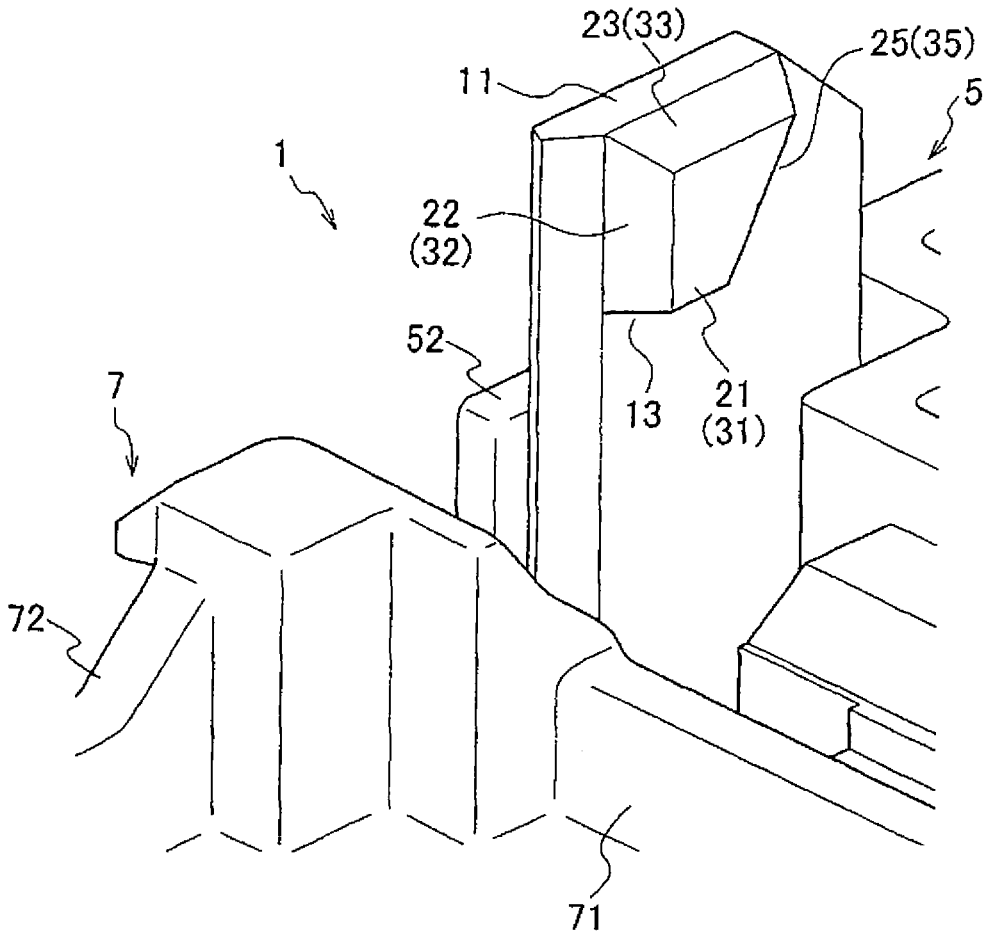
FIG. 2 is a perspective view showing a lock arm portion in the fuse unit 1.
Figure 3:
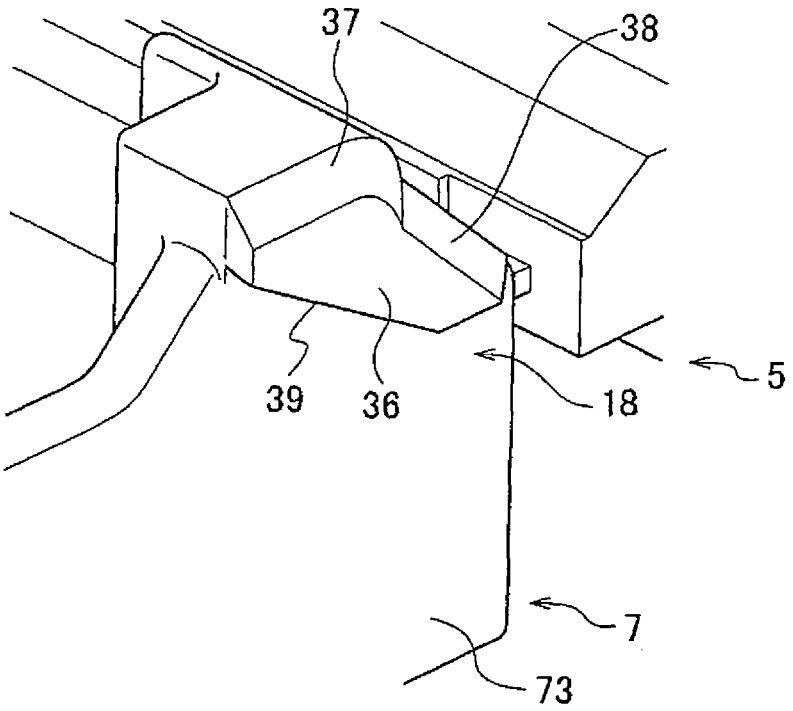
FIG. 3 is a perspective view showing a protrusion portion in the fuse unit 1.
Figure 4:
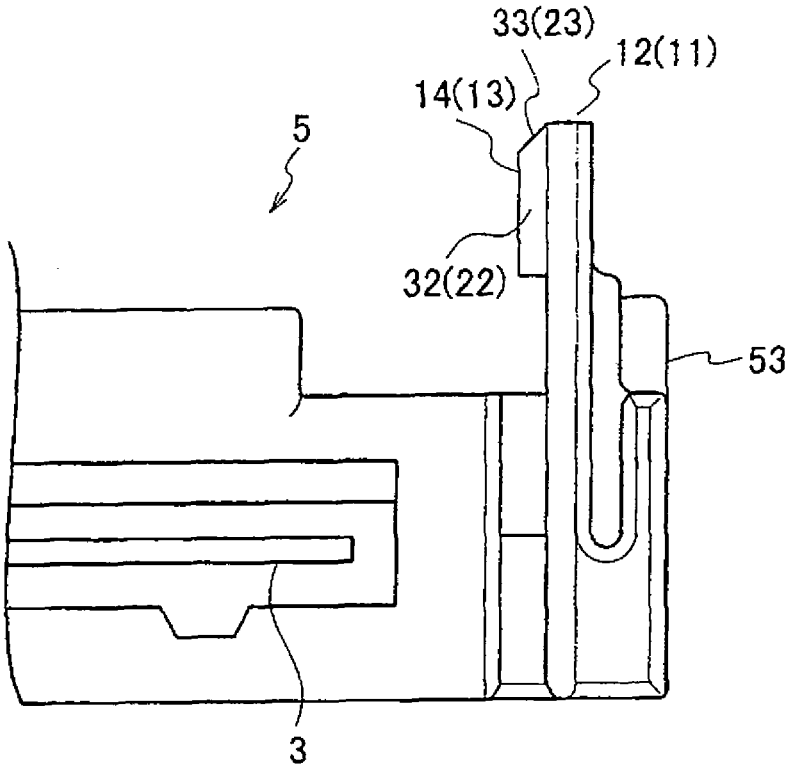
FIG. 4 is a view showing the lock arm portion in the fuse unit 1.
Figure 5:
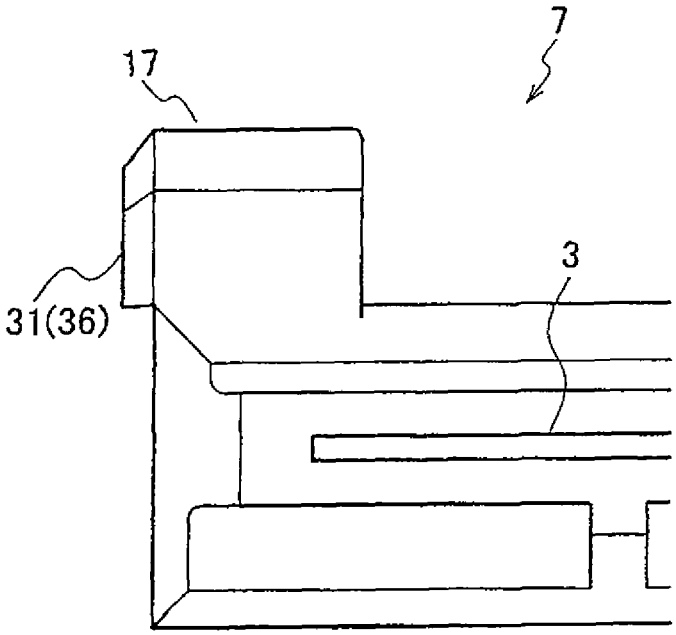
FIG. 5 is a view showing the protrusion portion in the fuse unit 1.
Figure 6:
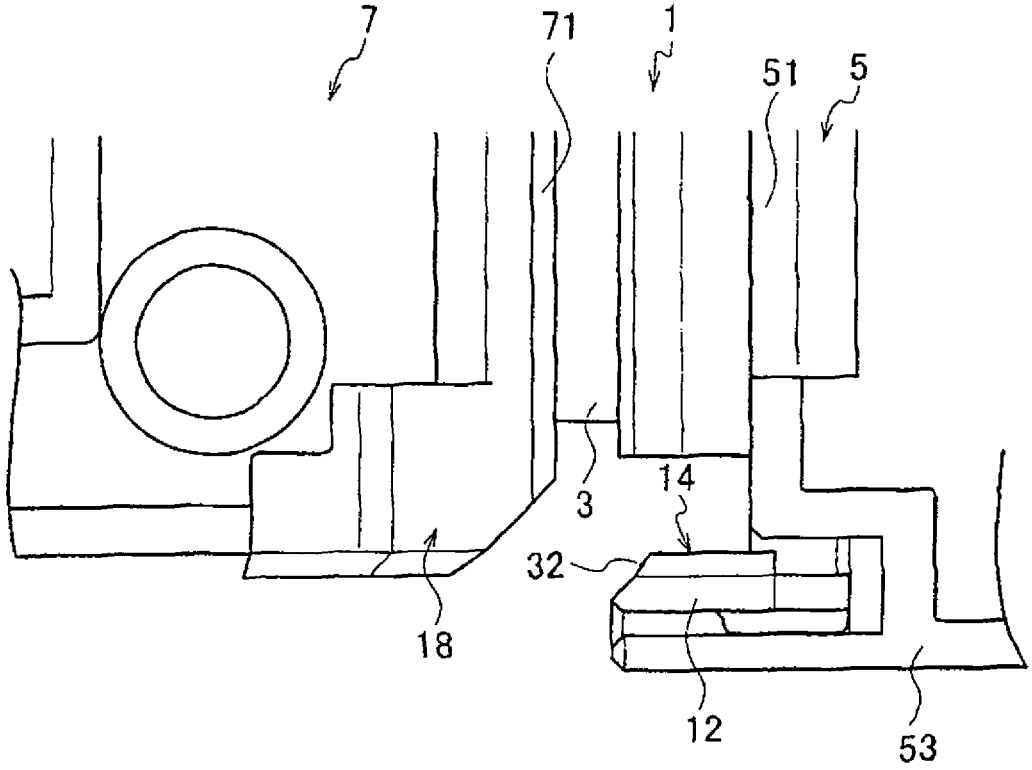
FIG. 6 is a plan view before two division bodies are bent.
Figure 7:
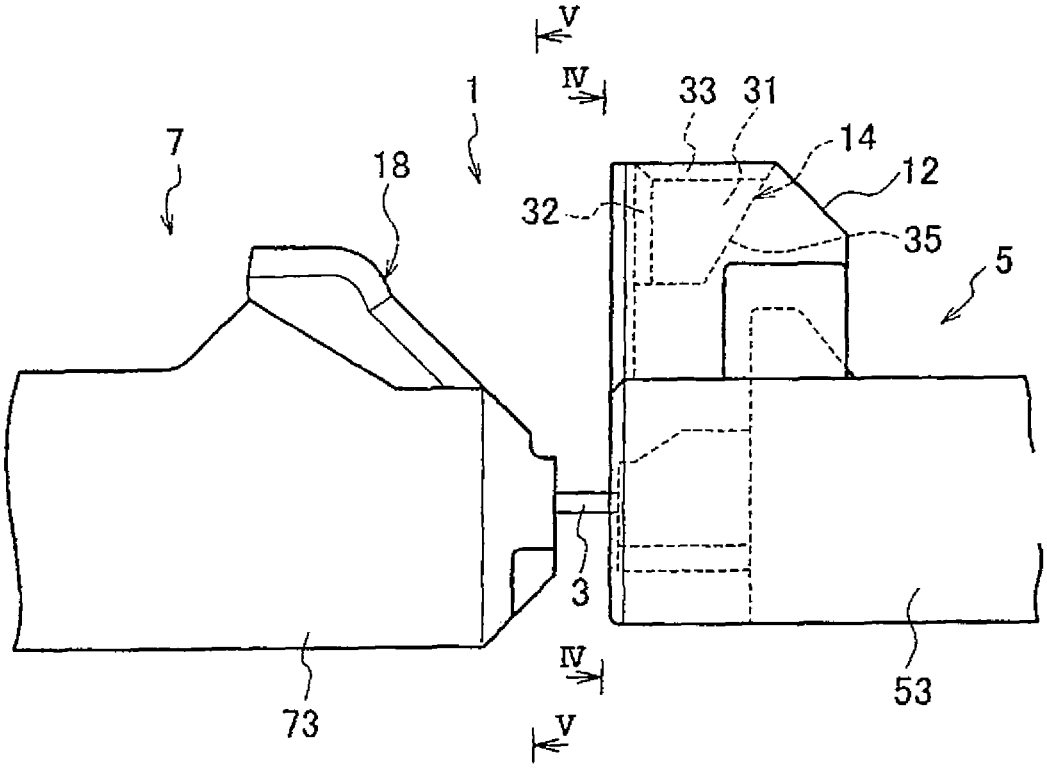
FIG. 7 is a side view before the two division bodies are bent.
Figure 8A:
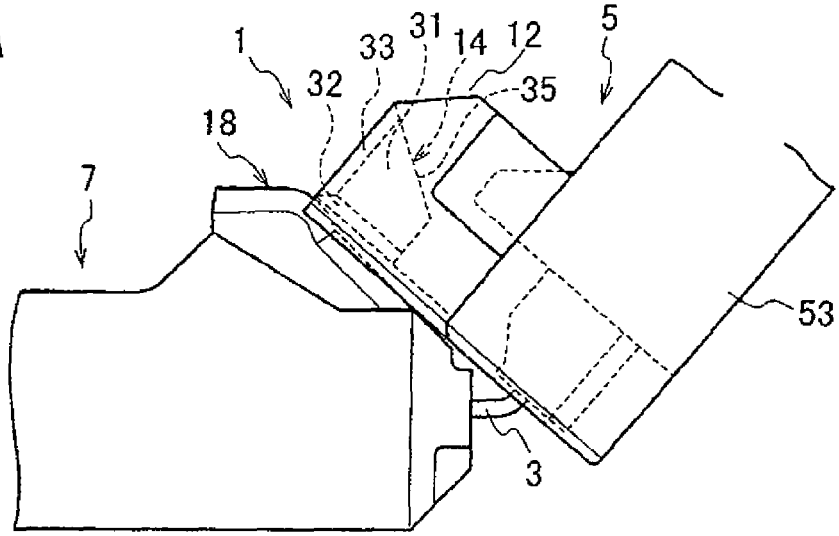
FIGS. 8A, 8B and 8C are side views showing operations of bending of the two division bodies.
Figure 8B:
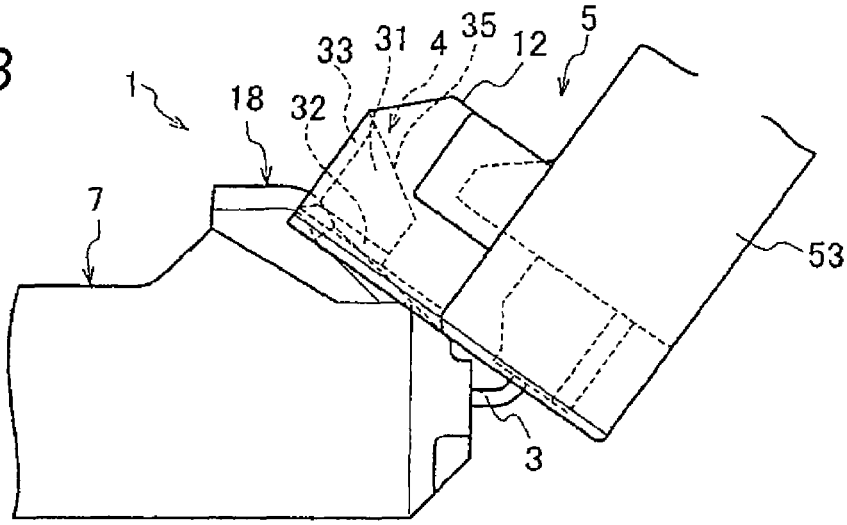
Figure 8C:
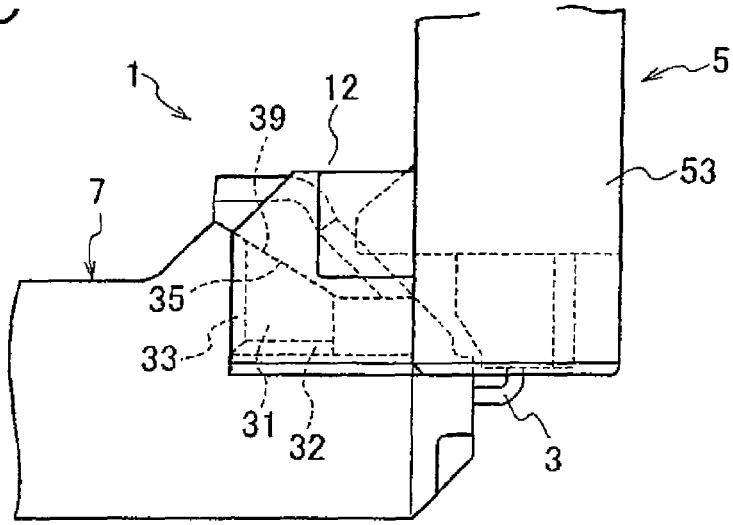
Figure 9:
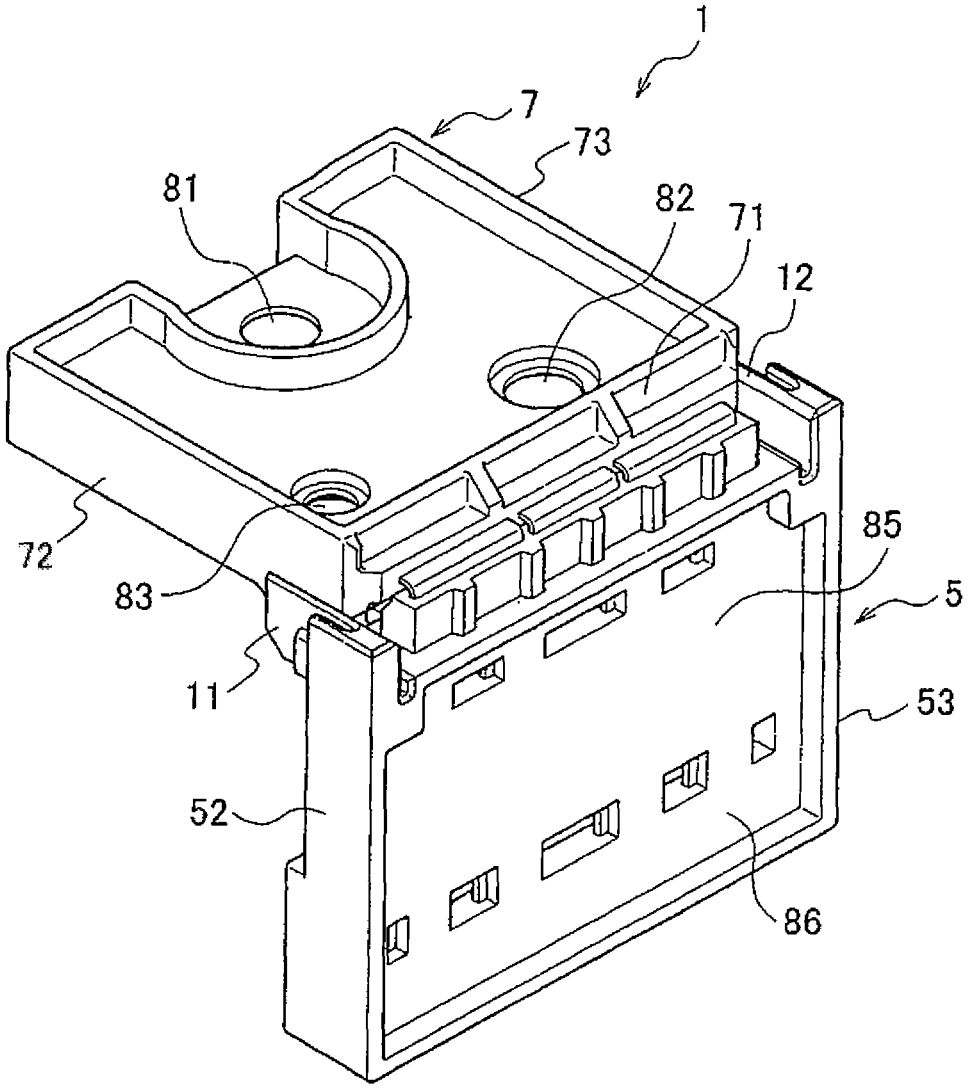
FIG. 9 is a perspective view showing a state of bending the two division bodies.
Figure 10:
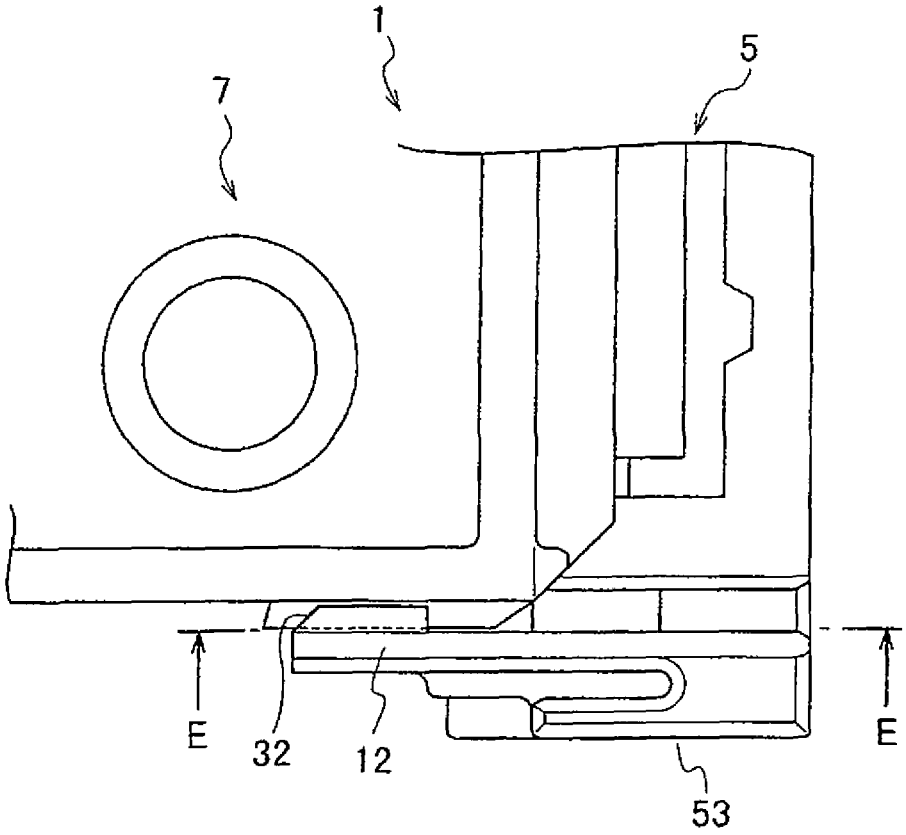
FIG. 10 is a plan view showing the state of bending the two division bodies.
Figure 11:
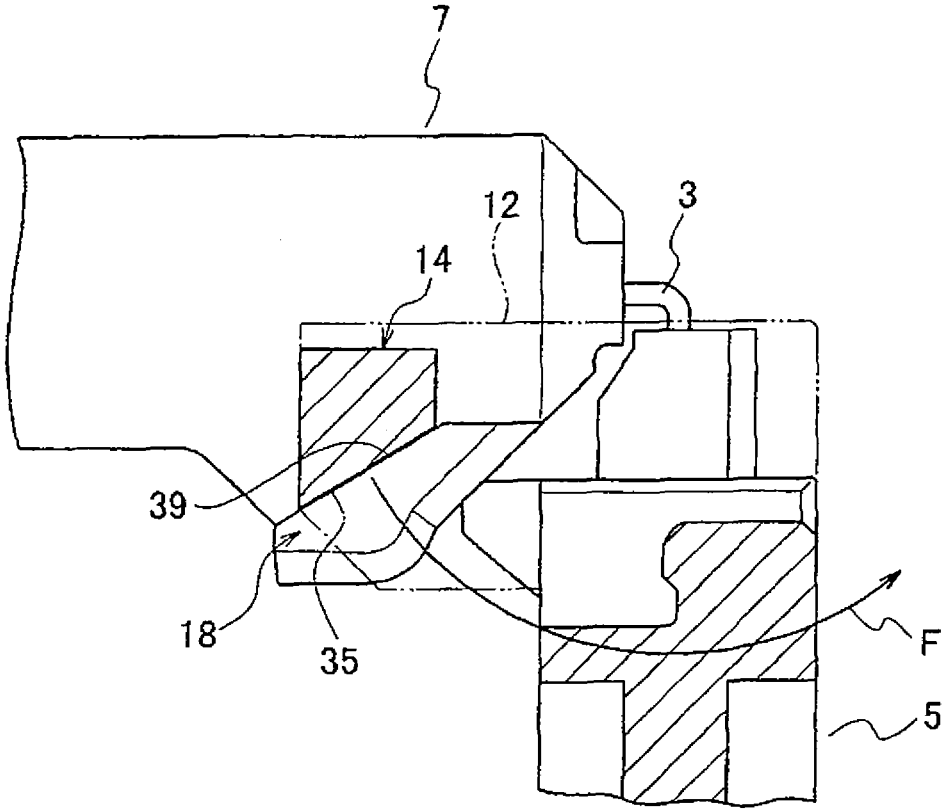
FIG. 11 is a side view taken on line E-E of FIG. 10 showing the state of bending the two division bodies.
Figure 12:
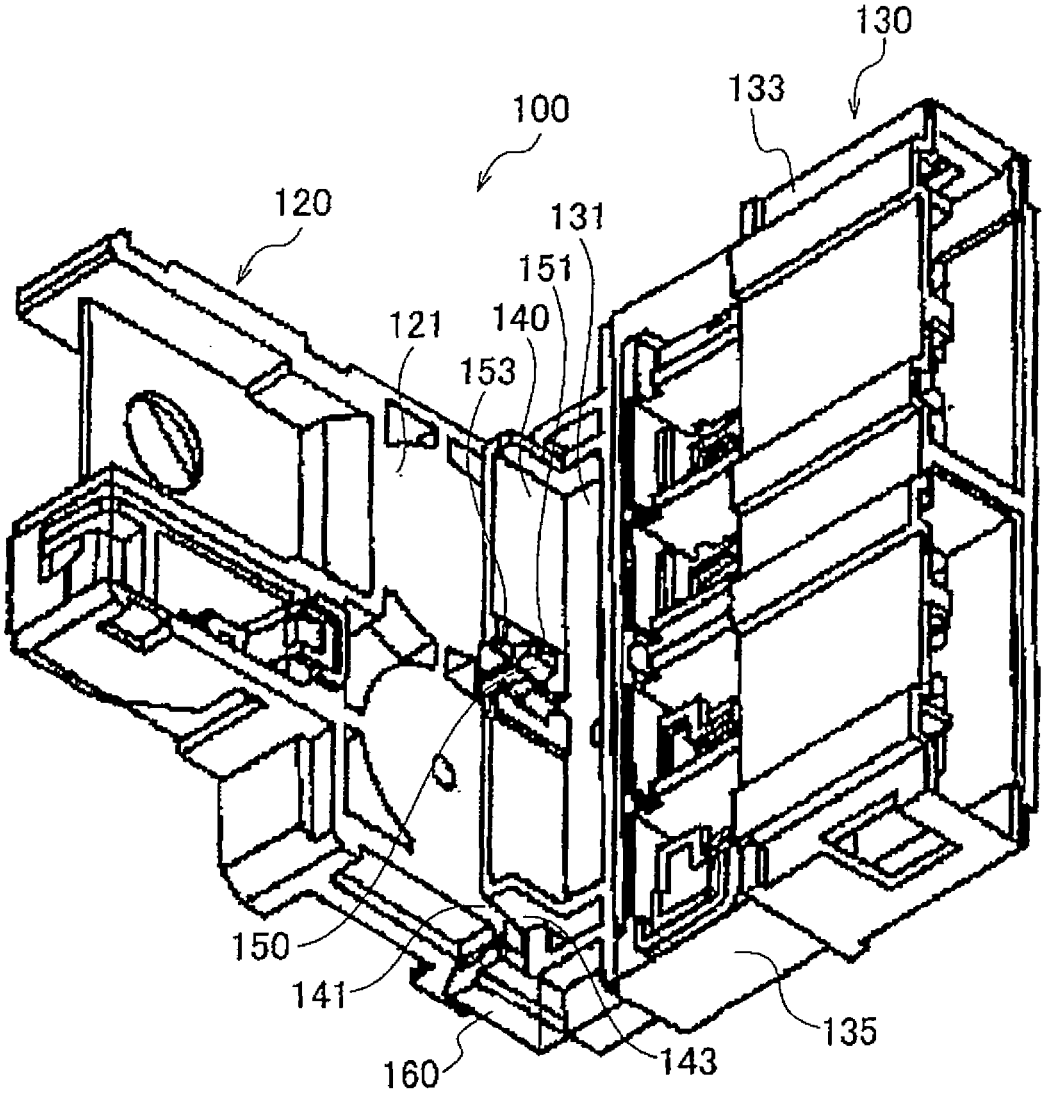
Fig. 12 PRIOR ART
FIG. 12 is a perspective view showing a state of bending a conventional fuse unit.

FIGS. 1 to 11 show a fuse unit 1 of one embodiment of the invention, and FIG. 1 is the whole perspective view of the fuse unit 1 of one embodiment of the invention, and FIG. 2 is a perspective view of a lock arm portion, and FIG. 3 is a perspective view of a protrusion portion, and FIG. 4 is a view of the lock arm portion (a view taken on arrow IV-IV in FIG. 7), and FIG. 5 is a plan view of the protrusion portion (a view taken on arrow V-V in FIG. 7), and FIG. 6 is a plan view before bending of the fuse unit 1, and FIG. 7 is a side view of the fuse unit 1, and FIG. 8 is a side view showing an operation of bending, and FIG. 9 is a perspective view showing a state of bending the fuse unit 1, and FIG. 10 is a plan view showing the state of bending the fuse unit 1, and FIG. 11 is a side view showing the state of bending the fuse unit 1 (a view taken on arrow E-E in FIG. 10).

As shown in FIGS. 1 and 9, the fuse unit 1 of this embodiment includes a fuse element (not shown) and an insulating resin body 2 into which the fuse unit is built. The fuse unit 1 distributes and supplies electric power of a battery to a power source for electric power supply by being directly mounted in the battery installed in a vehicle.

The fuse element is made of a conductive metal plate and is molded integrally with the resin body 2 by being inserted into a metal mold in the case of molding the resin body 2. Plural fuses or tab terminals (not shown) are formed in the fuse element. The middle of the fuse element forms a flexible hinge part 3 (see FIGS. 6 to 8) exposed from the resin body 2, and the resin body 2 can be bent about the hinge part 3 as described below.

The resin body 2 is formed by two division bodies 5, 7. The two division bodies 5, 7 are divided around the hinge part 3 of the fuse element, and the hinge part 3 of the fuse element is exposed to the middle of the division bodies 5, 7. The resin body 2 described above is bent so as to form an L shape about the hinge part 3 of the fuse element. By being bent in the L shape thus, the fuse unit 1 can cope with arrangement of many circuits inside narrow space. Hereinafter, the division body 5 is described as one division body 5 and the division body 7 is described as the other division body 7.

As shown in FIGS. 1 and 9, a terminal connection part 81 of a battery terminal, a terminal connection part 82 of an alternator terminal and a terminal connection part 83 of a starter motor terminal are formed in the other division body 7. One division body 5 has a fuse built-in part 85 and a tab terminal built-in part 86.

An opposed wall part 51 and an opposed wall part 71 mutually opposed around the hinge part 3 of the fuse element are formed in one division body 5 and the other division body 7 (see FIGS. 1, 6 and 9). Side wall parts 52, 53 of both sides extending in an intersection direction orthogonal to the opposed wall part 51 are parallel formed in the opposed wall part 51 in one division body 5, and side wall parts 72, 73 of both sides extending in an intersection direction orthogonal to the opposed wall part 71 are parallel formed in the opposed wall part 71 in the other division body 7. Also, all the side wall parts 52, 53 and the side wall parts 72, 73 become parallel between the division bodies 5, 7.

A pair of lock arms 11, 12 is formed in one division body 5. The lock arms 11, 12 are disposed in the side wall parts 52, 53 in one division body 5 and are positioned in the side of the hinge part 3 in the side wall parts 52, 53. By disposing the lock arms 11, 12 in the side wall parts 52, 53, the lock arms 11, 12 are positioned in both ends of a width direction which is a longitudinal direction of the hinge part 3 in one division body 5. The lock arms 11, 12 are disposed so as to stand from inner wall portions of the corresponding side wall parts 52, 53 in a thickness direction of the conductive metal plate of the fuse element positioned in the side of the division body 5. Also, the lock arms 11, 12 are formed in some thin shape and consequently, flexibility capable of flexing in a thickness direction which is equal to the width direction of the fuse unit 1 is given.

Lock projections 13, 14 which are an example of an engaging part for lock are respectively disposed in the respective lock arms 11, 12. The lock projection 13 is disposed in the lock arm 11 and the lock projection 14 is disposed in the lock arm 12. These lock projections 13, 14 are disposed on opposed surfaces of the lock arms 11, 12. In addition, details of the lock projections 13, 14 will be described below.

A pair of protrusions 17, 18 is disposed in the other division body 7. The protrusions 17, 18 which are an example of an engaged part for lock are disposed in the side wall parts 72, 73 in the other division body 7 and are positioned in the side of the hinge part 3 in the side wall parts 72, 73. By disposing the protrusions 17, 18 in the side wall parts 72, 73 of the other division body 7, the protrusions 17, 18 are positioned in both ends of the width direction in the other division body 7. In this case, the protrusion 17 corresponds to the lock projection 13 of the lock arm 11 and the protrusion 18 corresponds to the lock projection 14 of the lock arm 12.

As shown in FIGS. 1 and 2, the lock projection 13 of the side of the lock arm 11 is disposed so as to protrude from the opposed surface of the lock arm 12 to the inside of the one division body 5 toward the lock arm 12, and a top surface of the lock projection 13 is formed in a slide surface part 21. The slide surface part 21 is formed in substantially a trapezoid surface and interference parts 22, 23 are consecutively disposed in two sides of the outside. The interference parts 22, 23 are formed by surfaces obliquely erected from the lock arm 11. A first inclined surface 25 is formed in the portion opposed to the interference parts 22, 23 in the lock projection 13. The first inclined surface 25 is formed in the surface obliquely erected from the lock arm 11. An inclination of the first inclined surface 25 is set in a direction, for example, an orthogonal direction, intersecting with respect to a reaction force by springbuck at the time of folding and plastically deforming the hinge part 3 of the fuse element. That is, the first inclined surface 25 is formed by a portion of the plane including the central axis of bending in the hinge part 3.

The lock projection 14 of the side of the lock arm 12 is formed so as to become plane-symmetrical to the lock projection 13 of the side of the lock arm 11, that is symmetrical with respect to a plane orthogonal to the central axis of bending of the hinge part 3 through the center of the width direction of the fuse unit 1, and as shown in FIG. 7, the top surface is formed in a slide surface part 31 and two sides of the outside of the slide surface part 31 are formed in interference parts 32, 33 and also a first inclined surface 35 is formed in the portion opposed to the interference parts 32, 33. Like the first inclined surface 25 of the lock projection 13, the first inclined surface 35 of the lock projection 14 is inclined in the direction intersecting with respect to the reaction force by springback of the fuse element.

As shown in FIG. 3, a top surface of the protrusion 18 corresponding to the lock projection 14 of the lock arm 12 is formed in a slide surface part 36 corresponding to the planar slide surface part 31 of the lock projection 14. Interference parts 37, 38 obliquely to the width direction of the fuse unit 1 erected from the side wall part 73 to the slide surface part 36 are formed in two sides of the outside of the slide surface part 36. The interference parts 37, 38 correspond to the interference parts 32, 33 in the lock projection 14. A second inclined surface 39 falling in an oblique direction from the slide surface part 36 is consecutively disposed in the portion opposed to the interference parts 32, 33 in the slide surface part 36. Like the first inclined surface 35 of the lock projection 14, the second inclined surface 39 is inclined in the direction intersecting with respect to the reaction force by springback of the fuse element.

When the two division bodies 5, 7 are bent at the hinge part 3, the interference parts 37, 38 of the protrusion 18 first interfere with the interference parts 32, 33 of the lock projection 14. By this interference, the lock arm 12 operates so as to flex toward the outside of the side wall part 53 of one division body 5. Subsequently, the slide surface part 36 of the protrusion 18 makes slidable contact with the slide surface part 31 of the lock projection 14. Further, in a state of finishing bending the two division bodies at the hinge part 3 by 90°, the lock projection 14 gets over the protrusion 18 and contact between the slide surface part 36 and the slide surface part 31 is eliminated and the lock arm 12 is restored. Then, the second inclined surface 39 of the protrusion 18 is aligned with the first inclined surface 35 of the lock projection 14 in surface contact between the surfaces 39 and 35 is made.

Though illustration is omitted, the protrusion 17 corresponding to the lock projection 13 of the lock arm 11 is formed so as to become plane-symmetrical to the protrusion 18 described above, and a slide surface part corresponding to the slide surface part 21 of the lock projection 13, interference parts corresponding to the interference parts 22, 23 and a the second inclined surface corresponding to the first inclined surface 25 are formed. Like the first inclined surface 25 of the lock projection 13, the second inclined surface of the protrusion 17 is inclined in the direction intersecting with respect to the reaction force by springback of the fuse element.

When the two division bodies 5, 7 are bent, like the lock projection 14 or the protrusion 18, simultaneously, the interference parts of the protrusion 17 first interfere with the interference parts 22, 23 of the lock projection 13 and by this interference, the lock arm 11 operates so as to flex toward the outside of the side wall part 52 of one division body 5. Subsequently, the slide surface part of the protrusion 17 makes slidable contact with the slide surface part 21 of the lock projection 13. Further, the second inclined surface of the protrusion 17 is aligned with the first inclined surface 25 of the lock projection 13.

Next, an operation of bending the resin body 2 of this embodiment will be described by FIGS. 7, 8, 10 and 11. These drawings show an operation of the lock arm 12 of the division body 5 and the protrusion 18 of the division body 7 corresponding to this lock arm 12. As can be seen already, the lock arm 11 and the protrusion 17 corresponding to this lock arm 11 operate similarly.

FIG. 7 shows a state before bending of the division bodies 5, 7, and the division bodies 5, 7 are bent from this state. FIG. 8A shows the original state of bending one division body 5 to the side of the other division body 7 about the hinge part 3 of the fuse element. In the state of FIG. 8A, the interference parts 32, 33 of the lock projection 14 disposed in the lock arm 12 approach the interference parts 37, 38 of the protrusion 18 of the side of the other division body 7.

FIG. 8B shows a state of further bending one division body 5, and the interference parts 32, 33 of the lock projection 14 interfere with the interference parts 37, 38 of the protrusion 18 in this state. By this interference, the lock arm 12 flexes to the outside of the side wall part 53. Also in the side of the lock arm 11, a similar operation is performed and the interference parts 22, 23 of the lock projection 13 interfere with the interference parts of the protrusion 17 of the other division body 7 and by this interference, the lock arm 11 flexes to the outside of the side wall part 52. Thus, the lock arms 11, 12 flex to the outsides of the side wall parts 52, 53 and thereby, one division body 5 can be bent smoothly.

FIGS. 8C, 10 and 11 show the final stage of bending in which one division body 5 is bent to an upright state in which the division body 7 is substantially orthogonal to the division body 5, and the resin body 2 becomes an L shape. In the final stage of bending, a state in which the first inclined surface 35 of the lock projection 14 in the lock arm 12 is aligned with the second inclined surface 39 of the protrusion 18 of the side of the other division body 7 is obtained. Similarly, a state in which the first inclined surface 25 of the lock projection 13 in the lock arm 11 is aligned with the second inclined surface of the protrusion 17 of the other division body 7 is obtained. In this state, interference between the interference parts 22, 23, 32, 33 of the lock projections 13, 14 and the interference parts 37, 38 of the protrusions 17, 18 is eliminated, so that the lock arms 11, 12 are returned to the original position.

The first inclined surfaces of the lock projections 13, 14 are aligned with the second inclined surfaces of the protrusions 17, 18 in the side wall parts of both sides of the division bodies 5, 7. As a result of this, the two division bodies 5, 7 are engaged in both ends of the width direction, and a bent state can surely be locked.

Also, as shown in FIG. 11, in this embodiment, the first inclined surfaces 25, 35 of the lock projections 13, 14 and the second inclined surfaces 39 of the protrusions 17, 18 are formed along the direction intersecting with respect to the reaction force by springback of the fuse element based on bending of the division bodies 5, 7, so that in a state of alignment between the first inclined surfaces 25, 35 and the second inclined surfaces 39 in a state in which the first inclined surface 25 is mutually in surface contact with one second inclined surface 39 and the first inclined surface 35 is mutually in surface contact with the other second inclined surface 39, these surfaces can surely be subjected to the reaction force F by springback. Therefore, the bent state can surely be fixed.

In this embodiment as described above, it can surely be subjected to a load of springback from the fuse element, so that the bent state of the division bodies 5, 7 can be held and damage to the resin body 2 can be prevented.

Further, in this embodiment, an extension line of alignment between the first inclined surfaces 25, 35 of the lock projections 13, 14 and the second inclined surfaces 39 of the protrusions 17, 18 matches with the center of bending of the division bodies 5, 7 which is the hinge part 3 as shown in FIG. 8C. As a result of this, it can surely be subjected to the reaction force of springback of the fuse element based on bending of the division bodies 5, 7, and the bent state of the division bodies 5, 7 can be held more stably.

The invention is not limited to the embodiment described above, and various modifications can be made.

The embodiment described above is constructed so that the lock arms 11, 12 flex to the outsides of the side wall parts by giving flexibility to the lock arms 11, 12, but is not limited to this, and flexibility may be given to the protrusions 17, 18 by disposing the protrusions 17, 18 of the other division body 7 through a slit with respect to a main body by disposing the protrusions 17, 18 in the top side of the arm part protruding from the division body 7. In this case, the protrusions 17, 18 flex to the insides of the side wall parts and thereby an operation of bending the division bodies 5, 7 can be performed smoothly.

Also, at least any of the interference parts 22, 23, 32, 33 of the lock projections 13, 14 and the interference parts 37, 38 of the protrusions 17, 18 may be omitted.

Further, it is unnecessary to set bending of the division bodies in the L shape, and it can also be applied to the fuse unit with a structure of stopping the bending before the L shape is formed.

The present application is based on Japanese Patent Application No. 2009-230528 filed on Oct. 2, 2009, the contents of which are incorporated herein for reference.

INDUSTRIAL APPLICABILITY

The present application is extremely useful in forming the fuse unit capable of being surely subjected to the load of springback from the built-in fuse element and holding the bent state of division bodies and preventing damage.

REFERENCE SIGNS LIST

1 fuse unit
2 resin body
3 hinge part
5 one division body
7 the other division body
11, 12 lock arm
13, 14 lock projection
17, 18 protrusion
21, 31, 36 slide surface part
22, 23, 32, 33, 37, 38 interference part
25, 35 first inclined surface
39 second inclined surface
51, 71 opposed wall part
52, 53, 72, 73 side wall part

The invention claimed is:

1. A fuse unit including a fuse element therein, the fuse unit comprising:

a first resin body;

a second resin body bendably attached to the first resin body by a hinge portion such that the second resin body is bendable around the hinge portion with respect to the first resin body in a bended state;

a first opposing wall provided on the first resin body;

a second opposing wall provided on the second resin body and opposing the first opposing wall, so that the hinge portion is disposed between the first opposing wall and the second opposing wall;

a pair of first side walls provided on the first resin body and extending in a direction intersecting an axis of the bending of the second resin body;

a pair of second side walls provided on the second resin body and extending in a direction intersecting the axis of the bending of the second resin body;

a pair of lock arms provided at respective ends of the first side walls closest to the hinge portion;

a pair of engaging parts, provided at the lock arms respectively, and each of which having a first inclined face; and a pair of engaged parts, provided at a side of the hinge portion in the second side walls respectively, and corresponding to the engaging parts respectively, and each of which having a second inclined face such that in the bended state the first inclined face is in surface contact with the second inclined face, wherein the first inclined face and the second inclined face are formed along a direction being substantially perpendicular to a direction of a reaction force by springback of the fuse element caused by the bending of the second resin body, wherein in the bended state, the first inclined face and the second inclined face are flush with each other such that the first inclined face is locked to the second inclined face, and wherein a majority of the first inclined face is flush with a majority of the second inclined face, and wherein the first inclined face and the second inclined face are diagonal to the pair of first side walls and the pair of second side walls.

2. The fuse unit as set forth in claim 1, wherein:

each of the engaging parts is a lock projection;

each of the engaged parts is a protrusion; and the lock projection and the protrusion contact each other and slide according to the bending of the second resin body.

3. The fuse unit as set forth in claim 1, wherein:

the lock arms have flexibility; and the lock arms are deformed outward of the first side walls according to the bending of the second resin body.

4. The fuse unit as set forth in claim 1, wherein:

an imaginary straight line parallel to the first inclined face and extended from the first inclined face intersects the axis of the bending of the second resin body in a state that the first inclined face is in surface contact with the second inclined face.

5. The fuse unit as set forth in claim 1, wherein:

the first resin body and the second resin body form a substantially L-shape in a state that the first inclined face is in surface contact with the second inclined face.

6. The fuse unit as set forth in claim 1, wherein:

bending of the second resin body with respect to the first resin body is stopped, by a contact between the pair of engaging parts and the pair of engaged parts, before forming an L-shape in a state that the first inclined face is in surface contact with the second inclined face.

7. The fuse unit as set forth in claim 1, wherein:

in a non-bended state where the second resin body is not bent around the hinge portion with respect to the first resin body, the first inclined face is arranged at an acute angle, between the first inclined face and a closest one of the pair of first side walls, with respect to a longitudinal direction of one of the pair of first side walls as a ray of the acute angle and the first inclined face as another ray of the acute angle, in the non-bended state, the second inclined face is arranged at an obtuse angle, between the second inclined face and the one of the pair of first side walls, with respect to the longitudinal direction as a ray of the obtuse angle and the second inclined face as another ray of the obtuse angle, and the one of the pair of first side walls is the closest of the pair of first side walls to both of the first inclined face and the second inclined face.

8. The fuse unit as set forth in claim 7, wherein:

the acute angle and the obtuse angle are supplementary angles with respect to each other.

9. The fuse unit as set forth in claim 1, wherein:

in a non-bended state where the second resin body is not bent around the hinge portion with respect to the first resin body, the pair of first side walls are parallel to the pair of second side walls, a two-dimensional (2D) plane is formed with a longitudinal direction of any one wall of the first side walls and the second side walls as an axis of the 2D plane and a longitudinal direction of the hinge portion, perpendicular to the any one wall, as a second axis of the 2D plane, the pair of engaging parts and the pair of engaged parts are over the 2D plane, with respect to a third axis perpendicular to the 2D plane, and the pair of engaging parts extends towards each other and the pair of engaged parts extend towards each other along respective axes which are each parallel to the longitudinal direction of the hinge.

* * * * *